US010155303B2

(12) United States Patent
Taylor

(10) Patent No.: US 10,155,303 B2
(45) Date of Patent: Dec. 18, 2018

(54) METHOD OF MANUFACTURING HYDRAULIC HAMMER USING MALE AND FEMALE GAUGES

(71) Applicant: Arrowhead Rockdrill Company Limited, Derbyshire (GB)

(72) Inventor: Eric Taylor, Derbyshire (GB)

(73) Assignee: Arrowhead Rockdrill Company Limited, Derbyshire (GB)

( * ) Notice: Subject to any disclaimer, the term of this patent is extended or adjusted under 35 U.S.C. 154(b) by 656 days.

(21) Appl. No.: 14/954,149

(22) Filed: Nov. 30, 2015

(65) Prior Publication Data

US 2016/0151902 A1 Jun. 2, 2016

(30) Foreign Application Priority Data

Dec. 1, 2014 (GB) ..... 1421275.7

(51) Int. Cl.
*B25D 9/00* (2006.01)
*B25D 9/12* (2006.01)
(Continued)

(52) U.S. Cl.
CPC ..... *B25D 9/00* (2013.01); *B25D 9/12* (2013.01); *B25D 17/00* (2013.01); *B25D 17/06* (2013.01);
(Continued)

(58) Field of Classification Search
CPC ..... Y10T 29/494; Y10T 29/49778; Y10T 29/4978; Y10T 29/4986; Y10T 29/49995; Y10T 29/49996; B25D 9/04; B25D 9/00; B25D 9/12; B25D 17/00; B25D 1/00; B25D 1/06; B25D 2217/0019; B25D 2250/065;
(Continued)

(56) References Cited

U.S. PATENT DOCUMENTS 4,109,734 A * 8/1978 Montabert ..... B25D 9/12 173/114
4,181,183 A * 1/1980 Okada ..... B25D 9/12 173/204
(Continued)

FOREIGN PATENT DOCUMENTS

DE 4003814 A * 8/1991 ..... B25D 9/00
JP 2008114300 A * 5/2008 ..... B25D 17/00

*Primary Examiner* — Jason L Vaughan
(74) *Attorney, Agent, or Firm* — Kilyk & Bowersox, P.L.L.C.

(57) ABSTRACT

A method of manufacturing a hydraulic hammer using a male gauge and a female gauge is provided wherein the hammer comprises a body and a chuck housing that are connectable by cooperatively formed thread fittings. A cooperatively threaded male gauge and female gauge can be used to form the threads on the body and the chuck housing and to determine the rotational orientation of the body and the chuck housing relative to one another. One of the gauges can be used to measure distortion of the chuck housing caused by heat treatment subsequent to the formation of the thread fitting and thereby to determine the required subsequent machining of the chuck housing necessary to retain the appropriate relative rotational orientation when the chuck housing is connected to the body. The method can comprise the steps of making and appropriately marking the male gauge and the female gauge.

13 Claims, 4 Drawing Sheets

(51) Int. Cl.

| | |
|---|---|
| ***C21D 1/18*** | (2006.01) |
| ***C21D 1/58*** | (2006.01) |
| ***C21D 9/00*** | (2006.01) |
| ***E02F 3/96*** | (2006.01) |
| ***E02F 9/26*** | (2006.01) |
| ***B25D 17/00*** | (2006.01) |
| ***B25D 17/06*** | (2006.01) |

(52) U.S. Cl.
CPC ..... *C21D 1/18* (2013.01); *C21D 1/58* (2013.01); *C21D 9/0068* (2013.01); *E02F 3/966* (2013.01); *E02F 9/264* (2013.01); *B25D 2217/0019* (2013.01); *B25D 2250/065* (2013.01); *B25D 2250/121* (2013.01); *B25D 2250/155* (2013.01); *B25D 2250/235* (2013.01); *B25D 2250/361* (2013.01)

(58) Field of Classification Search
CPC ..... B25D 2250/121; B25D 2250/155; B25D 2250/235; B25D 2250/361; B23P 15/10; C21D 1/18; C21D 1/58; C21D 9/0068; E02F 3/966; E02F 9/264
See application file for complete search history.

(56) References Cited

U.S. PATENT DOCUMENTS

| | | | | |
|---|---|---|---|---|
| 4,290,496 | A * | 9/1981 | Briggs | E21B 7/18 173/76 |
| 4,614,120 | A * | 9/1986 | Fradin | E21B 19/166 116/212 |
| 4,745,981 | A * | 5/1988 | Buske | B25D 9/145 173/202 |
| 4,819,542 | A * | 4/1989 | Fadeev | B25D 9/12 91/172 |
| 6,067,701 | A * | 5/2000 | Vandewalle | A61F 2/30721 29/558 |
| 6,460,276 | B1 * | 10/2002 | Ireland | E02F 3/405 37/444 |
| 9,822,802 | B2 * | 11/2017 | Moore | F16J 3/02 |
| 2005/0145400 | A1 * | 7/2005 | Ottestad | B25D 9/12 173/91 |
| 2005/0167131 | A1 * | 8/2005 | Hurskainen | B25D 9/145 173/206 |
| 2006/0037845 | A1 * | 2/2006 | Yoshimura | E04G 23/082 200/50.01 |
| 2007/0068707 | A1 * | 3/2007 | Henriksson | B25D 9/125 175/417 |

* cited by examiner

Figure 1A
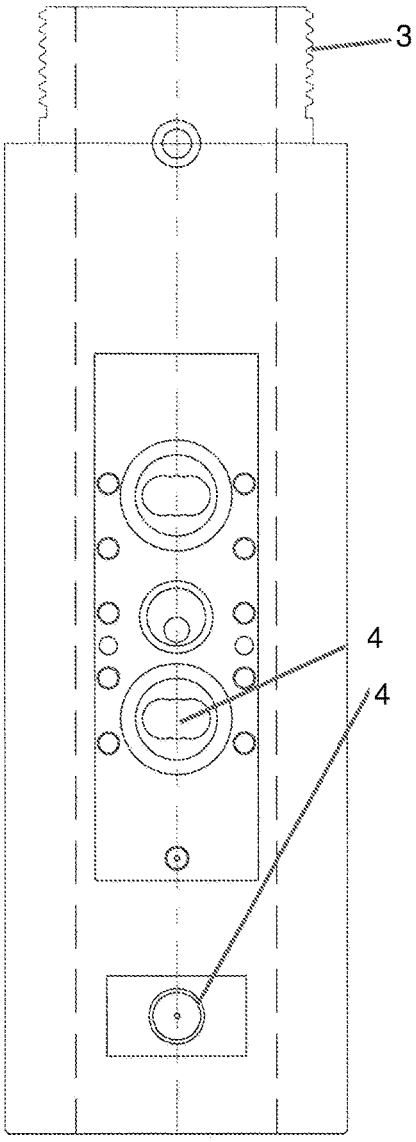
Figure 1B
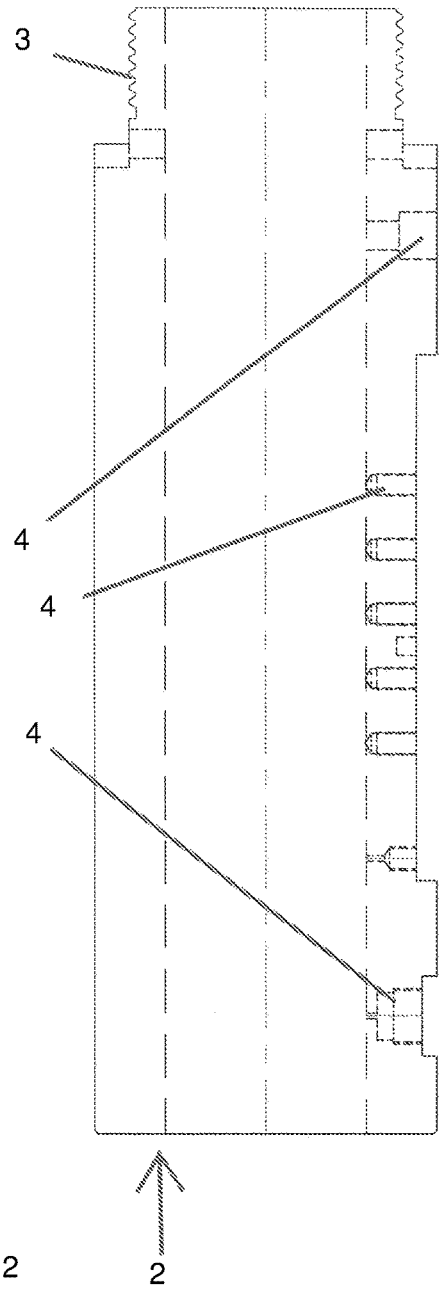
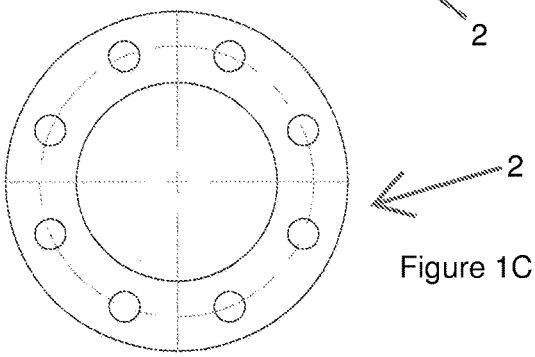
Figure 1C

METHOD OF MANUFACTURING HYDRAULIC HAMMER USING MALE AND FEMALE GAUGES

CROSS-REFERENCE TO RELATED APPLICATION

This U.S. Patent Application claims priority to Great Britain Application No. GB 1421275.7 filed Dec. 1, 2014, which is incorporated herein in its entirety by reference.

FIELD OF THE INVENTION

The present invention relates to hydraulic hammers, also known as breakers. The invention provides a new method for manufacturing hydraulic hammers using male and female gauges such that a body and chuck housing of a hammer can be screwed together, rather than connected using tie rods or a clip.

BACKGROUND TO THE INVENTION

Hydraulic hammers are also known as breakers and are percussion hammers that are generally powered by high pressure hydraulic oil supplied by an auxiliary hydraulic system. In use they are mounted on an excavator or other mobile construction equipment. They are typically used to break up and excavate areas of concrete, rock or other similar materials.

Generally, a hydraulic hammer is substantially formed of three major components: a chuck housing, a main body, and a head cap. The chuck housing holds and directs a tool piece or a chisel. It is this tool piece or chisel that impact the material to be broken. The main body holds a piston. It is this piston that strikes the tool or chisel and imparts impact energy to the tool piece or chisel. The head cap contains pressurized gas, usually nitrogen. As the piston is raised by hydraulic oil pressure it rises into the pressurized gas in the head gap, thereby further pressurizing the gas. At the top of the piston's stroke hydraulic oil pressure is removed and the pressurized gas acts to accelerate the piston downwards, striking the tool piece or chisel.

In most current hydraulic hammers the chuck housing, main body, and head cap are held together using tie rods. Typically, a hydraulic hammer will have four tie rods holding the chuck housing, main body, and head cap together. In some alternative hydraulic hammers the chuck housing, main body, and head cap are held together using one or more clips.

Due to the conditions in which they are operated, it is not unusual for the tool piece of a hydraulic hammer to become embedded in the material that is being excavated. This material may be concrete or rock. If this happens, the tool piece is usually dislodged by levering the hammer backwards and forwards whilst simultaneously operating the hammer and thereby breaking the tool piece free. Doing this can transfer significant leverage stresses to tie rods or clips that are holding the hammer together. This can lead to the failure of the tie rods or clips due excessive tensile load being placed upon them. Therefore, there has been a long-standing need for hydraulic hammers wherein the chuck housing, body, and head cap are connected without using tie rods or clips.

It has been proposed to have at least the chuck housing and the body of a hydraulic hammer joined by threaded fittings such that they can be screwed together. Such fittings would overcome the problems associated with the use of tie rods and clips. However, it is not straightforward to machine threaded fittings in the body or chuck housing of a hydraulic hammer.

Both the body and the chuck housing of a hydraulic hammer have components that are required to be held in the correct rotational orientation. As a result, it is of vital importance that the chuck housing of a hydraulic hammer can be accurately rotationally aligned with the body to which it is attached. This is something that is simple to do when the body and chuck housing are joined by tie rods. It is not as simple to accurately rotationally align a body and a chuck housing that are joined by threaded fittings. This is because it is typically necessary to heat treat the chuck housing of a hydraulic hammer after machining. This heat treatment causes significant distortion and dimensional changes to the chuck housing. As a result, if a threaded fitting is machined in a chuck housing using conventional manufacturing methods such that it rotationally aligns with a cooperatively threaded body, after heat treatment there would be significant misalignment when the chuck housing is screwed together with that body. Due to this difficulty, it has been considered difficult, if not impossible, to accurately construct hydraulic hammers with threaded fittings.

In light of the above, there is a need for a method of manufacturing a hydraulic hammer wherein the body and the chuck housing can be screwed together and held in accurate rotational alignment using cooperatively formed threaded fittings. Currently, there is no such method in the public domain.

SUMMARY OF THE INVENTION

The present invention provides a method of manufacturing a hydraulic hammer using male and female gauges, the hammer comprising a chuck housing with a first threaded fitting and a body machined with a cooperatively formed second threaded fitting such that the chuck housing and the body may be screwed together, the male and female gauges each having a thread that is formed to allow the gauges to be screwed together and each having at least one circumferential marking such that the gauges' relative rotational position can be determined when they are screwed together, the method comprising the steps of:

machining the chuck housing with the first threaded fitting such that a first of the male and female gauges can be screwed therein;

fully screwing the first gauge into the chuck housing and marking the chuck housing such that the rotational position of the first gauge relative to the chuck housing can be determined;

removing the first gauge;

hardening the chuck housing;

determining the distortion of the chuck housing caused by the hardening by fully screwing the first gauge into the chuck housing and determining their relative rotational positions;

machining the chuck housing on the basis of the determined distortion; and machining the body with the second threaded fitting such that a second of the male and female gauges can be screwed thereon.

The method of the present invention is advantageous as, by using gauges, it allows a hydraulic hammer to be constructed wherein the chuck housing and the body are screwed together and thereby held in precise rotational alignment using the first threaded fitting and the second threaded fitting, despite the hardening treatment of the chuck housing and resulting distortion after the initial machining of the first threaded fitting. Specifically, it is the use of first and second gauges to form the first threaded fitting and the second threaded fitting and to determine the distortion of the chuck housing caused by the hardening treatment that makes this possible.

The distortion of the chuck housing can be determined using the relative rotational positions of the first gauge and the chuck housing when they are fully screwed together without difficulty. This is done in the following manner. The first gauge and the chuck housing have markings that allow their relative rotational positions to be determined when they are screwed together. A first relative rotational position can be measured from the markings when they are fully screwed together before the chuck housing is hardened and a second relative rotational position can be measured from the markings when they are fully screwed together after the chuck housing is hardened. The angular difference between the first and second rotational positions can then be measured to give a difference in rotational alignment that has resulted from the hardening of the chuck housing.

For any bodies in threaded connection there will be a direct correspondence between relative rotational movement of the bodies and their relative axial movement. In particular, the relative rotational movement will be directly proportional to their relative axial movement. The exact correspondence of the relative rotational and axial movements can be easily calculated from the characteristics of the thread, in particular the lead, pitch, and starts of the thread. In the present method the characteristics of the thread of the first gauge and of the chuck housing will be known by the person carrying out the method. Therefore, by measuring the difference in rotational alignment due to hardening in the manner set out above the axial distortion of the chuck housing due to the hardening can be immediately calculated. This axial distortion can then be used to determine how best to machine the chuck housing.

The markings on the first and second gauges may be any markings that allow their relative rotational position to be determined. Preferably any markings will be provided such that when a gauge is fully screwed onto another object with an appropriate threaded fitting the marking is adjacent a surface of that object. At their very simplest, each of the first and second gauges may have a single circumferential marking, which may be a zero mark. However, it may be preferable that one or both of the first and second gauges have a plurality of regularly spaced circumferential markings. These markings may be provided with a scale that corresponds to the angular distance around the circumference from a zero mark, the zero mark may or may not be arbitrary. That is, an arbitrary position can be chosen as the zero mark of one or both gauges or a zero mark may be chosen due to a specific rotational feature of one or both gauges. Preferably, the first and second gauges will both have a zero mark and those zero marks will be in alignment with one another when the first and second gauges are fully screwed together. Any markings on the first and second gauges will be positioned such that they are externally visible when the gauges are fully screwed into a cooperating fitting.

The marking of the chuck housing will preferably be a single circumferential marking and will preferably be provided at a position that abuts any object that is fully screwed onto the chuck housing using the first threaded fitting. The marking will also be provided such that it is easily visible when the first gauge is screwed fully onto the chuck housing using the first threaded fitting. The chuck housing may be marked such that it has a single circumferential marking that is in alignment with a zero (or datum) mark of the first gauge when the first gauge is fully screwed onto the chuck housing.

The chuck housing of the present method may be initially provided having an axial length that is required for the final hydraulic hammer. Alternatively, the chuck housing may be provided having an additional axial length. This additional axial length may be small and may be less than 1 mm. In a preferred embodiment of the invention the chuck housing is provided with an additional axial length of 0.1 mm. If the chuck housing is provided with an additional axial length it may be preferable that the additional length is provided at an axial end of the housing at which the first threaded fitting is machined such that the first threaded fitting has an additional length of thread at its outer end. That additional length of thread having an axial length equal to the additional axial length of the chuck housing. Therefore, if the additional axial length of the chuck housing were machined away the resulting chuck housing would have a first thread fitting with a thread of appropriate orientation at its outer end.

It may be preferable to provide a chuck housing with additional axial length in order to allow more accurate machining of the chuck housing after it is hardened. In particular, the hardening of the chuck housing may only distort the chuck housing a small amount along its axial length: this distortion may be less than 0.1 mm. Therefore, by providing the chuck housing with an additional (or excess) axial length it makes it easier to machine the chuck housing after hardening to the desired length.

If the chuck housing is provided with an additional axial length it may be preferable that, when the first gauge is fully screwed into the chuck housing, the chuck housing is not marked at a circumferential position in alignment with a zero mark of the first gauge, rather a single circumferential marking of the chuck housing may be provided at a predetermined angular offset from a zero (or datum) mark of the first gauge. The predetermined angular offset being dependent upon the additional axial length and being the additional angular distance that the first gauge could be screwed into the chuck housing if the additional axial length of the chuck housing were machined away. This angular offset will be dependent upon the pitch of the thread of the first gauge and the length of the additional axial length and will be able to be easily calculate by a person skilled in the art.

The method of the present invention may further comprise the step of providing features on the body in positions determined by the angular position of the second gauge when it is fully screwed in the body. As will be readily understood a body of hammer is not a simple cylinder and will have a plurality of features formed thereon or therethrough in order to allow the hammer to function properly. The rotational position of these features relative to the chuck housing may be important. Therefore, in order to provide the features at a predetermined rotational position relative to the chuck housing they can be provided in positions determined by the angular position of the second gauge when it is fully screwed onto the body. In particular, they may be provided in positions in relative to a zero mark marked on the second gauge when the second gauge is fully screwed onto the body. A zero mark of the second gauge may correspond to a zero mark on the first gauge, which, in turn will correspond to a zero mark on the chuck housing (see above). Therefore, by positioning features on a body in an appropriate rotational position relative to a zero mark on the second gauge, when the second gauge is fully screwed onto the body they may also be provided in the same relative rotational position to the chuck housing when it is fully screwed onto the body.

The method of the present invention may comprise the step of screwing the chuck housing and the body together using the first threaded fitting and the second threaded fitting. The body and the chuck housing should be screwed together until an outer face of the threading fitting of each component abut with one another. In this manner, a safe, reliable, and resilient connection can be made between the chuck housing and the body. This connection will be much more resilient to tensile stresses caused by levering the hammer than a connection formed using tie rods and/or clips.

The first gauge may be either the male gauge or the female gauge. The first gauge may be the male gauge, in which case the second gauge will be the female gauge. In this case, a hammer formed using these gauges will have a chuck housing with a female thread and a body with a male thread. Alternatively, the first gauge may be the female gauge and the second gauge may be the male gauge. In this case, a hammer formed using these gauges will have a chuck housing with a male thread and a body with a female thread. The choice of whether the first gauge is the male or the female gauge will be down to the preference of the manufacturer based on the requirements for the specific hammer.

The chuck housing may be hardened using any method apparent to the person skilled in the art. It may be preferable that the chuck housing is hardened by heat treatment and oil quenching.

The step of machining the chuck housing on the basis of the determined distortion may be done in any manner apparent to the person skilled in the art. As will be readily appreciated, generally the chuck housing should be machined such that when the first gauge is fully screwed into the first threaded fitting the zero mark of the first gauge and the mark on the chuck housing are aligned.

A simple way to achieve this is to machine down a face of the housing at an outer end of the first threaded fitting. The amount by which the chuck housing will need to be machined down can be easily calculated from the determined distortion of the chuck housing caused by the hardening, as discussed above. If the chuck housing is provided with an additional axial length, as discussed above, the additional axial length will also be machined away during this step.

The method of the present invention may further comprise the step of providing at least one feature of the chuck housing in a position determined by the rotational position of the chuck housing when it is fully screwed onto the body. As will be readily appreciated a chuck housing may not be entirely rotationally symmetric; it may have one of more features that are required to be located on the chuck housing such that it is in a predefined rotational position relative to the body when the body and the chuck housing are connected. Therefore, the method of the present invention may include a step of providing any such feature. Any such feature may be provided before or after hardening of the chuck housing. The correct rotational position of any such feature may be determined from the position of the marking made on the chuck housing. As set out above, this marking will correspond to the rotational position the chuck housing will be in when the body is fully screwed thereon. Further, the position of the marking is determined by the position of the first gauge when it is fully threaded thereon prior to the hardening of the chuck housing.

The male and female gauges may be formed of any suitable material. It may be preferable that they are formed of a heat treatable bar stock material. For example, the male and female gauges may be formed of either EN19 steel or EN24 steel. It will be generally preferable that the male and female gauges are formed of the same material.

The method of the present invention may further comprise the step of manufacturing the male and female gauges. The male and female gauges may be manufactured in any manner apparent to the person skilled in the art and have any of the features discussed herein. It is anticipated that they should be able to be manufactured without difficulty using conventional techniques. For example, the male and female gauges may be machined from bar stock material, as set out above. After machining the male and female gauges may be heat treated using a heat treatment method that causes little or no deformation. For example, the heat treatment may be nitriding heat treatment. The step of manufacturing the male and female gauges may include the step of marking the gauges in a manner described above.

Further features and advantages of the present invention will be apparent from the preferred embodiment, which is described below, and from the drawings.

BRIEF DESCRIPTION OF THE DRAWINGS

The present invention can be even more fully understood with the reference to the accompanying drawings which are intended to illustrate, not limit, the present invention.

FIGS. 1A-1C are diagrams of a body formed according to the method of the present invention;

DETAILED DESCRIPTION OF THE INVENTION

A body 2 of a hammer formed according to a method of the present invention is shown in FIGS. 1A-1C. The body 2 is substantially cylindrical and has a male threaded fitting 3 at a first end. The body 2 has various other structural features 4 formed thereon. These features 4 are formed at an appropriate rotational position relative to the threaded fitting 3. The specific function of the features 4 is not relevant to the present invention and will not be described further, although their function will be immediately apparent to the skilled person.

Figure 2A:
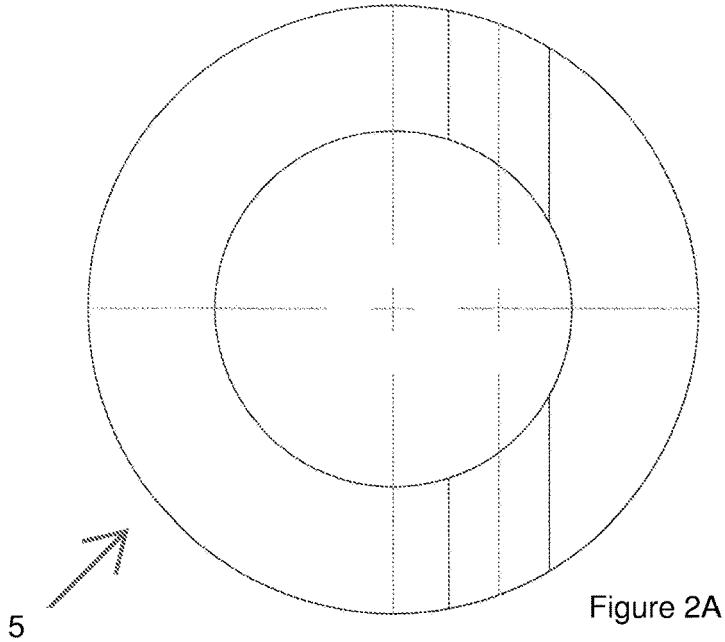
FIGS. 2A-2B are diagrams of a chuck housing formed according to the method of the present invention.
Figure 2B:
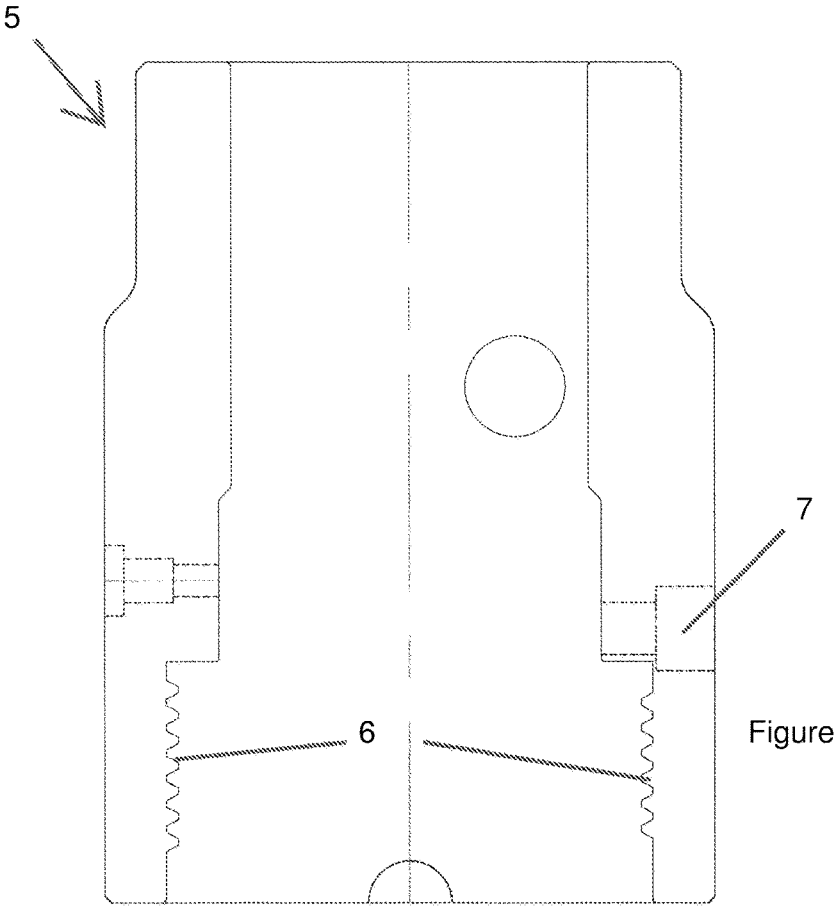

A chuck housing 5 of a hammer according to the present invention is shown in FIGS. 2A-2B . The chuck housing 5 is also substantially cylindrical and has a female threaded fitting 6 at a first end. The chuck housing 5 has a drill hole 7 formed through a cylindrical sidewall. The drill hole 7 is formed at an appropriate rotational position relative to the threaded fitting 6.

Figure 3:
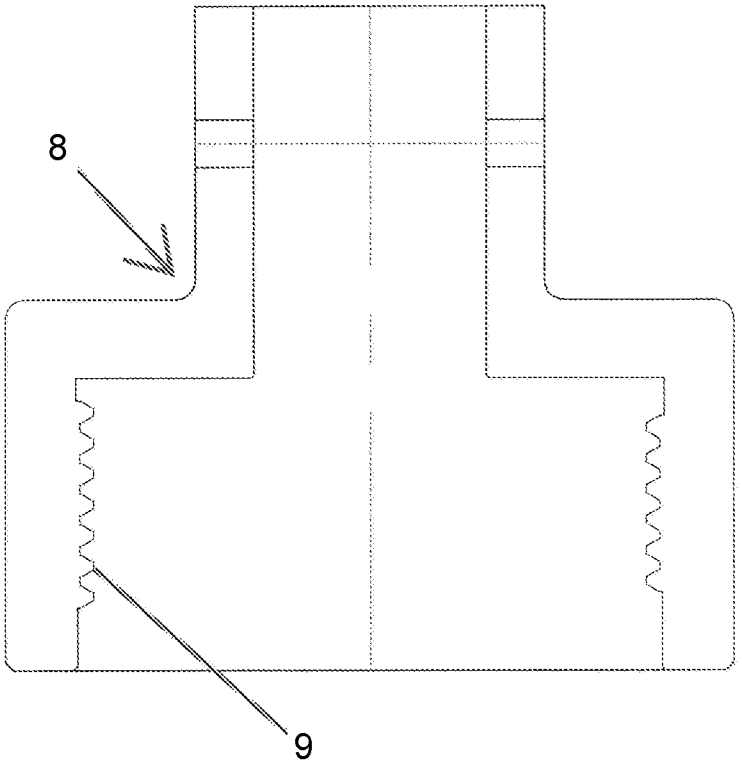
FIG. 3 is an axial cross-section through a female gauge used in the method of the present invention.

A female gauge 8 used in the method of the present invention is shown in FIG. 3. The female gauge 8 is substantially cylindrical and has a female threaded fitting 9 at a first end. For reasons explained below, the female threaded fitting 9 of the female gauge 8 is substantially identical to the female threaded fitting 6 of the chuck housing 5 and fits with the male threaded fitting 3 of the body 2.

Figure 4:
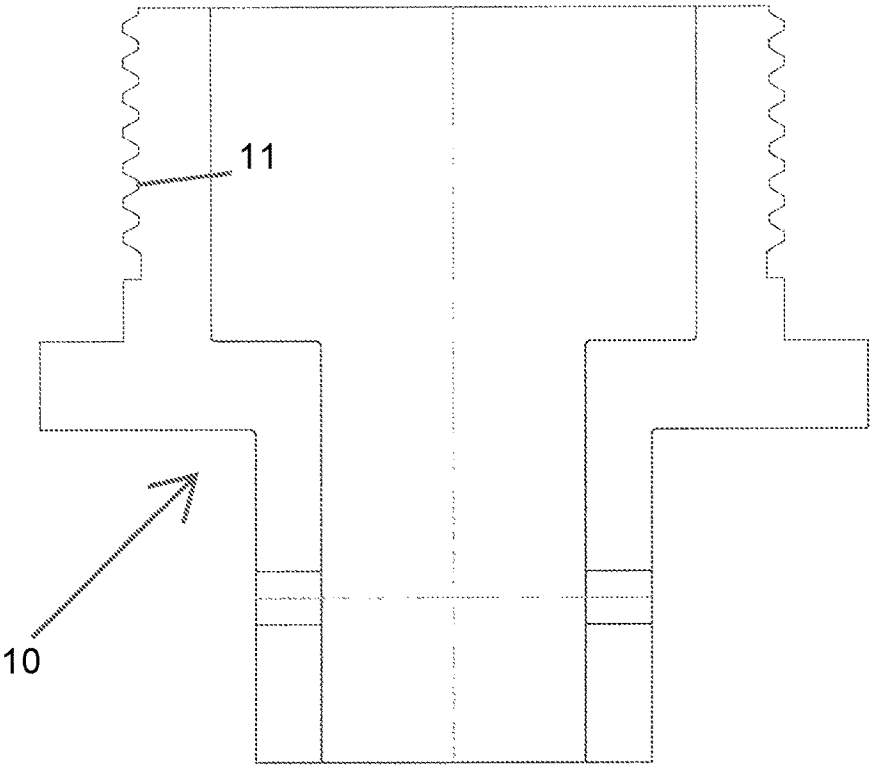
FIG. 4 is an axial cross-section through a male gauge used in the method of the present invention.

A male gauge 10 used in the method of the present invention is shown in FIG. 4. The male gauge 10 is substantially cylindrical and has a male threaded fitting 11 at a first end. For reasons explained below, the male threaded fitting 11 of the male gauge 10 fits the female threaded fitting 9 of the female gauge and the female threaded fitting 6 of the chuck housing 5 and is substantially identical to the male threaded fitting 3 of the body 2.

A hammer formed using the method of the present invention would also comprise further components including, but not limited to, a tool piece, a tool retainer, a lower cylinder liner, and a piston. The arrangement of these components with the chuck housing 5 and the body 2 will be immediately apparent to the person skilled in the art and, as such, they have not been illustrated in the Figures. It is considered that the skilled person would immediately understand what further components a hammer may comprise and their relation to the chuck housing 5 and body 2 shown in the Figures.

In use, the body 2 is connected to the chuck housing 5 by means of the female threaded fitting 6 of the chuck housing and the male threaded fitting 3 of the body. The tool piece 12 is mounted in the chuck housing 5. The tool lower cylinder liner 14 is positioned within the chuck housing 5 and the body 2, around the tool piece 12 and the piston 15.

The method of the present invention is used to manufacture the body 2 and the chuck housing 5 of the hammer in the following manner.

Any pair of a male gauge 10 and a female gauge 8 may be used to make many identical hammers so it is not an essential step of the method of the present invention to make the male and female gauges. In the majority of instances of the use of the method of the present invention the person using the method will be able to utilise pre-existing and appropriate male and female gauges 10, 8 and will not be required to make the gauges.

However, in some instances of the present invention it will be necessary for the person to machine new male and female gauges 10, 8. In such instances the first step of the method will be to machine a male gauge 10 and a female gauge 8 from a heat treatable bar stock material, such as EN19 or EN24 steel. The male and female gauges 10, 8 having a nominal bore size corresponding to the thread size required for the body 2 and the chuck housing 5. The male and female gauges 10, 8 are then screwed firmly together and a zero line (not shown) is marked across both gauges. The male gauge 10 is then marked at regular circumferential increments from the zero line, each marking corresponding to an angular distance from the zero line. The pitch of the threaded fittings 11, 9 will be known. Therefore, each marking will also correspond to an axial separation as the male gauge 10 is rotated apart from the female gauge 8. In particular, when a specific marking of the male gauge 10 is aligned with the zero mark of the female gauge 8 the male gauge will have been rotated apart from the female gauge 8 by the angular distance of that mark. This angular distance will be directly proportional to the corresponding axial separation of the male gauge 10 and the female gauge 8. The marks of the male gauge 10 may be scribed with this angular distance and/or the corresponding axial separation.

After marking, each of the male gauge 10 and the female gauge 8 will be heat treated by a nitriding heat treatment system. This heat treatment causes little or no deformation of the male gauge 10 and the female gauge 8 and ensures that the accuracy of the zero marks and of the marks of the male gauge is retained.

After making the male gauge 10 and the female gauge 8 or after selecting an appropriate pre-existing male gauge 10 and female gauge 8, the body 2 and the chuck housing 5 are made.

The body 2 is machined with the male thread fitting 3. The male thread fitting 3 is machined to be a firm but easy screw fit with the female thread fitting 9 of the female gauge 8.

The chuck housing 5 is machined with the female thread fitting 6. The female thread fitting 6 is machined to be a firm but easy screw fit with the male thread fitting 11 of the male gauge 10. The chuck housing 5 is initially formed such that it is slightly longer in axial length than is finally required. In particular it may be formed with a portion containing a female thread fitting 6 that extends axially outwards 0.1 mm further than is desired: such that if the 0.1 mm of additional chuck housing 5 at an outer end of the female thread fitting 6 were machined away the chuck housing would be of the desired length and the male gauge 10 would screw into the female thread fitting 6 such that when it is fully screwed in and in abutment with the chuck housing 5 it is in the preferred relative rotational alignment.

The female gauge 8 is fully screwed onto the male thread fitting 3 of the body 2 and in this position a zero mark corresponding to the zero mark of the female gauge is marked on the body 2. The female gauge 8 may then be removed from the body 2. The features 4 of the body 2 are then machined on the body in a position relative to the zero mark on the body.

The male gauge 10 is fully screwed onto the female thread fitting 6 of the chuck housing 5 such that it is in abutment with the chuck housing. A zero mark is then marked on the chuck housing 5. This zero mark is positioned at a predetermined angular distance from the zero mark of the male gauge 10. This angular distance is dependent on the additional axial length of the chuck housing 5. In particular, the angular distance directly corresponds to the additional axial length and is the angular distance by which the male gauge 10 could be further screwed into the chuck housing 5 were the additional axial length not present. The angular distance can be easily able to be calculated form the pitch of the thread and the additional axial length.

The male gauge 10 is then removed from the chuck housing 5. The chuck housing 5 is then hardened by heat treatment and oil quenching. This hardening alters the chuck housing 5 dimensionally, such that if the chuck housing 5 and the body 2 were immediately screwed together there would be a significant further rotational misalignment between the zero marks thereof. As a result, it is necessary to machine the chuck housing 5.

In order to do this, the male gauge 10 is again fully screwed onto the female thread fitting 6 of the chuck housing 5. In this position the zero mark of the chuck housing 5 is rotationally misaligned with the zero mark of the male gauge 10. The angular separation between the zero mark of the chuck housing 5 and the zero mark of the male gauge 10 will correspond to the axial length by which the chuck housing is required to be shortened in order to bring the zero marks back into alignment. Thus, the angular separation between the zero mark of the chuck housing 5 and the zero mark of the male gauge 10 is measured and thereby the length of axial length that is required is determined. The first end of the chuck housing 5 is then machined to reduce the axial length of the threaded fitting 11 by the determined amount. The amount removed includes the additional axial length with which the chuck housing 5 was initially formed.

Finally, the chuck housing 5 and the body 2 may be screwed together in order to form a hammer and when this is done the zero mark of the housing and the body will be aligned. This ensures that all bodies 2 and chuck housings 5 of hammers made according to the method of the present invention can be interchanged and it is not necessary to replace both the body and the housing of a hammer if only one requires replacing.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A method of manufacturing a hydraulic hammer using male and female gauges;

the hammer comprising a chuck housing with a first threaded fitting and a body machined with a cooperatively formed second threaded fitting such that the chuck housing and the body are configured to be screwed together;

the male and female gauges each having a thread that is formed to allow the gauges to be screwed together and each having at least one circumferential marking such that the gauges' relative rotational position can be determined when they are screwed together;

the method comprising the steps of:

machining the chuck housing with the first threaded fitting such that a first of the male and female gauges can be screwed therein;

fully screwing the first gauge into the chuck housing and marking the chuck housing such that a rotational position of the first gauge relative to the chuck housing can be determined;

removing the first gauge;

hardening the chuck housing;

determining the distortion of the chuck housing caused by the hardening by fully screwing the first gauge into the chuck housing and determining their relative rotational positions;

machining the chuck housing on the basis of the determined distortion; and machining the body with the second threaded fitting such that a second of the male and female gauges can be screwed thereon.

2. The method of claim 1, further comprising the step of:

providing features on the body in positions determined by the angular position of the second gauge when it is fully screwed on the body.

3. The method of claim 1, further comprising the step of:

screwing the chuck housing and the body together using the first threaded fitting and the second threaded fitting.

4. The method of claim 1, wherein the first gauge is the male gauge and the second gauge is the female gauge.

5. The method of claim 1, wherein the first gauge is the female gauge and the second gauge is the male gauge.

6. The method of claim 1, wherein a predetermined offset is included when marking the chuck housing.

7. The method of claim 1, wherein the chuck housing is hardened by heat treatment and oil quenching.

8. The method of claim 1, wherein the chuck housing is machined by machining down a face of the housing at an outer end of the first threaded fitting.

9. The method of claim 1, further comprising the step of:

providing at least one feature on the chuck housing in positions determined by the position of the first gauge when it is fully threaded therein.

10. The method of claim 9, wherein the gauges are heat treated by a nitriding heat treatment system after manufacture.

11. The method of claim 1, wherein the male and female gauges are formed of a heat treatable bar stock material.

12. The method of claim 11, wherein the male and female gauges are formed of EN19 steel or EN24 steel.

13. The method of claim 1, further comprising the step of manufacturing the male and female gauges.

* * * * *